United States Patent [19]

Bridges

[11] Patent Number: 5,012,868

[45] **Date of Patent: * May 7, 1991**

[54] CORROSION INHIBITION METHOD AND APPARATUS FOR DOWNHOLE ELECTRICAL HEATING IN MINERAL FLUID WELLS

[75] Inventor: Jack E. Bridges, Park Ridge, Ill.

[73] Assignee: Uentech Corporation, Denver, Colo.

[ * ] Notice: The portion of the term of this patent subsequent to Apr. 24, 2007 has been disclaimed.

[21] Appl. No.: 322,930

[22] Filed: Mar. 14, 1989

[51] Int. Cl.[5] ..... E21B 43/24; E21B 41/02

[52] U.S. Cl. ..... 166/248; 166/60; 166/65.1; 166/902; 204/196

[58] Field of Search ..... 166/248, 65.1, 60, 53, 166/902; 219/277, 278; 204/196, 147

[56] References Cited

U.S. PATENT DOCUMENTS

| | | | |
|---|---|---|---|
| 2,801,697 | 8/1957 | Rohrback | 166/902 |
| 3,220,942 | 11/1965 | Crites | 204/196 |
| 3,642,066 | 12/1972 | Gill | 166/60 X |
| 3,674,662 | 7/1972 | Haycock | 204/196 X |
| 3,724,543 | 4/1973 | Bell et al. | 166/248 |
| 3,734,181 | 5/1973 | Shaffer | 166/65.1 |
| 4,010,799 | 3/1977 | Kern et al. | 166/248 |
| 4,211,625 | 7/1980 | Vandevier et al. | 204/196 X |
| 4,413,679 | 11/1983 | Perkins | 166/248 |
| 4,790,375 | 12/1988 | Bridges et al. | 166/60 |
| 4,919,201 | 4/1990 | Bridges et al. | 166/60 |

*Primary Examiner*—Hoang C. Dang
*Attorney, Agent, or Firm*—Kinzer, Plyer, Dorn, McEachran & Jambor

[57] ABSTRACT

Method and apparatus for corrosion inhibition in an electromagnetic heating system for heating a portion of a mineral fluid deposit adjacent an oil well or other mineral fluid well, in situ. The preferred apparatus includes a power source, that develops a high amperage heating current, over 100 amperes, at a heating frequency usually in a range of from 0.01 Hz or lower to 35 Hz, in a heating circuit that includes a main heating electrode downhole of the well and a return electrode. The power source also supplies a very low amplitude, controlled D.C. bias current to those electrodes, maintaining the main electrode at a neutral or negative polarity for corrosion protection. The D.C. bias current is monitored and maintained below a given minimum level, usually about one ampere, to extend the effective life of the return electrode and to minimize corrosion protection costs.

31 Claims, 7 Drawing Sheets

SWITCHING A.C. TO D.C. CONVERTER
D.C. BIAS SUPPLY
A.C. CURRENT SENSOR
D.C. VOLTAGE SENSOR
D.C. CURRENT SENSOR
HEATING CONTROL
FROM WELL SENSORS
POWER SOURCE 635
LOAD 673

CORROSION INHIBITION METHOD AND APPARATUS FOR DOWNHOLE ELECTRICAL HEATING IN MINERAL FLUID WELLS

BACKGROUND OF THE INVENTION

In-place reserves of heavy oil in the United States have been estimated about one hundred fifty billion barrels. Of this large in-place deposit total, however, only about five billion barrels may be considered economically produceable at current oil prices. One major impediment to production of oil from such deposits is the high viscosity of the oil. The high viscosity reduces the rate of flow through the deposit, particularly in the vicinity of the well bore, and consequently increases the capital costs per barrel so that overall costs per barrel become excessive.

Various techniques have been tried to stimulate flow from wells in heavy oil deposits. One technique utilizes steam to heat the oil around the well; this method has been utilized mostly in California. However, steam has drawbacks in that it is not applicable to thin reservoirs, is not suitable for many deposits which have a high clay content, is not readily applicable to off-shore deposits, and cannot be used where there is no adequate water supply.

There have also been a number of proposals for the use of electromagnetic energy, usually at conventional power frequencies (50/60 Hz) but sometimes in the radio frequency range, for heating oil deposits in the vicinity of a well bore. In field tests, it has been demonstrated that electromagnetic energy can thus be used for local heating of the oil, reducing its viscosity and increasing the flow rate. A viscosity reduction for oil in the immediate vicinity of the well bore changes the pressure distribution in the deposit to an extent such that flow rates may be enhanced as much as three to six times.

Perhaps the most direct and least costly method of implementation of electromagnetic heating of deposits in the vicinity of a well bore utilizes existing oil well equipment and takes advantage of conventional oil field practices. Thus, conventional steel well casing or production tubing is often employed as a part of the conductor system which delivers power to a main heating electrode located downhole in the well, at the level of the oil or gas deposit. However, the high magnetic permeability of a steel casing or tubing, with the associated eddy current and hysteresis losses, often creates excessive power losses in the transmission of electrical energy down through the wellbore to the main electrode. Such power losses are significant even at the conventional 50/60 Hz supply frequencies that are used almost universally. These losses may be mitigated by reducing the A.C. power frequency, as transmitted to the downhole heating electrode, but this creates some substantial technical problems as regards the electrical power source, particularly if the system must be energized from an ordinary 50/60 Hz power line.

Many of the technical difficulties in the use of low frequency A.C. power in heating oil and like deposits to improve well production are effectively solved by the power sources described and claimed in the co-pending, U.S. patent application of J. E. Bridges et al Ser. No. 322,012 filed simultaneously herewith, now U.S. Pat. No. 4,919,201. But other problems, particularly corrosion problems, remain.

A major difficulty with the use of low frequency A.C. power for localized heating of deposits in a heavy oil well arises because corrosion effects at low frequencies (e.g., below thirty-five Hz) are substantially enhanced in comparison with the corrosion that occurs in heating systems using conventional power frequencies of 50/60 Hz. Thus, for extended well life it is important to incorporate cost effective corrosion protection in the heating system.

Conventional corrosion protection arrangements for pipelines and oil wells usually include coating the pipe, casing, tubing, etc., of whatever configuration, with a layer of insulator material. In an electromagnetic heating system for an oil well, which must deliver power to a main heating electrode located far downhole at the oil deposit level, a secondary or return electrode is also required. That is, there are two exposed, uninsulated electrodes in the system, a main electrode downhole in the region of the oil deposit and a return electrode spaced from the main electrode. The secondary electrode is usually located above the deposit. To maintain conduction and heating, these electrodes must be positioned so that electrical energy flowing between them passes through a localized portion of the deposit. Accordingly, surface insulation can be used on only a portion of the electromagnetic well heating system. The most critical element, of course, is the exposed main heating electrode located downhole in the deposit; it cannot easily be replaced. Thus, corrosion damage to the downhole main heating electrode may shorten the life of the heating system substantially and may greatly reduce its economic value.

Further, maintaining the electrode in the deposit at too large a negative potential can cause a buildup of scale that may plug casing perforations or screens in this part of the well. Such excess scale accumulation at the downhole electrode is quite undesirable. Depending on the specifics of the application, it may be desirable to reduce the D.C. component of the current between the electrodes to as small a value as possible or to hold the downhole electrode at the least practical negative potential. This suppresses scale buildup on the reservoir electrode and reduces anodic corrosion losses at the return electrode.

Cathodic protection has been widely used for pipelines, oil wells, and other similar applications. This technique involves maintenance of a buried metal component, insulated or exposed, at a negative potential with respect to the earth. In this way, positive metallic ions that would normally be driven out from the buried metal element are attracted back into it, suppressing the corrosion rate. Of course, this requires that another exposed metal element or electrode be placed in the earth and maintained at a positive potential. In cathodic protection, as otherwise in the physical world, there is no free lunch. The positive D.C. potential of the secondary electrode drives the positively charged metallic ions into the earth and causes corrosion at the secondary electrode, the anode, at a rate that is a function of the D.C. bias current and the metallic constituents of the anode. Consequently, the positively charged return electrode is sometimes called the "sacrificial electrode". Sacrificial electrodes are usually designed either to be replaced or to have sufficient metal or chemical constituents so that they can withstand continued corrosion losses over an acceptable life for the system. Long life secondary electrodes (e.g., high silicon steel) are of material assistance in keeping secondary electrodes in service, but even this expedient is inadequate if large D.C. currents are tolerated.

Conventional cathodic protection systems cannot handle the large A.C. currents (e.g., 50 to 1000 amperes) often required for effective electromagnetic downhole heating in oil wells and like mineral fluid wells. This is especially true for currents in a low frequency range, such as between 0.01 and 35 Hz. Another difficulty with some of the known cathodic protection systems is that they are predicated upon application of a fixed potential large enough to assure that the protected metallic equipment (in this instance the downhole main heating electrode) is always negative with respect to the earth. But corrosion related currents and voltages vary with changes in heating currents. For an electromagnetically heated oil well, the rate of heating required for efficient operation may vary with changes in the production rate of the well, its oil/water ratio, the electrochemical constituents of the reservoir fluids, and other factors. Even in non-reservoir formations, these phenomena impose variable requirements with respect to the D.C. corrosion-protection bias. As a consequence, for most conventional cathodic protection systems excessive voltage requirements are imposed, with the result that there is excessive corrosion (and loss of efficiency) at the return electrode. The return electrode is likely to be overdesigned and undesirably expensive; D.C. power requirements are also excessive.

There is another type of oil well heating system in which the heat is applied to the flow of oil within the well itself, rather than to a localized portion of the deposit around the well. Such a heating system, usually applied to paraffin prone wells, is described in Bridges et al U.S. Pat. No. 4,790,375, issued Dec. 13, 1988. In a system of this kind the heating element or elements constitute the casing, the production tubing, or both; the high hysteresis and eddy current losses in steel tubing make its use frequently advantageous. In such systems it is frequently desirable to supply heating power to the system at frequencies substantially above the normal power range of 50/60 Hz, but corrosion problems generally similar to those in low frequency deposit heating systems may occur.

SUMMARY OF THE INVENTION

It is a primary object of the present invention, therefore, to provide new and improved methods and apparatus for corrosion protection of electromagnetic heating systems for oil wells, other mineral fluid wells, or other similar applications that are simple and economical in construction, reliable in operation over extended periods of time, and inexpensive to maintain.

A specific object of the invention is to provide a new and improved apparatus for energizing an electromagnetic downhole heating system in an oil well or the like, having the attributes described above, that affords maximum corrosion protection over an extended working life at minimum cost.

Accordingly, the invention relates to a method of corrosion inhibition in an electromagnetic heating system for a mineral fluid well, the heating system including a heating circuit comprising a heating electrode located downhole in the well, and an electrical power source, connected to the heating circuit and operating to maintain a a high amplitude A.C. heating current in the heating circuit, the method comprising the following steps:

A. applying a low D.C. bias voltage to the heating circuit, in addition to the high amplitude heating current, with a polarity to inhibit corrosion of the downhole heating electrode;

B. sensing the D.C. bias current in the heating circuit; and

C. adjusting the D.C. bias voltage to maintain the D.C. bias current sensed in step B below a given minimum level.

In another aspect, the invention relates to an electrical energizing apparatus for an electromagnetic heating system for an oil well or other mineral fluid well including a main heating electrode located downhole in the well at a level adjacent a mineral fluid deposit and a return electrode at a location remote from the main electrode so that an electrical current between the electrodes passes through and heats a portion of the mineral fluid deposit. The electrical energizing apparatus comprises an A.C. power source for generating a high amplitude A.C. heating current, of at least fifty amperes, a D.C. bias source for generating a low amplitude D.C. bias current having a polarity such as to inhibit corrosion at the main electrode, and connection means for applying both the A.C. heating current and the D.C. bias current to the electrodes of the well heating system.

DESCRIPTION OF THE PREFERRED EMBODIMENTS

Figure 1:
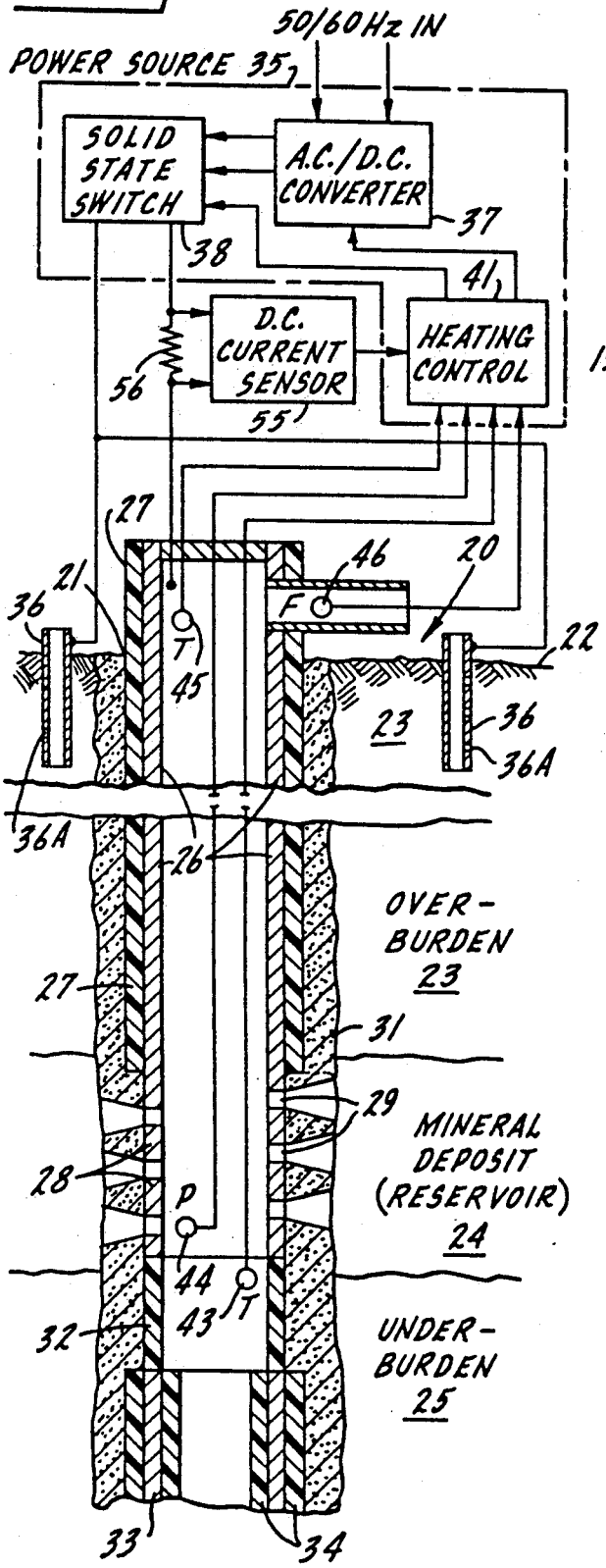
FIGS. 1 and 2 are simplified schematic sectional elevation views of two different oil wells, each equipped with a downhole electromagnetic heating system including an energizing apparatus embodying the present invention in a system that affords effective cathodic protection to a main downhole heating electrode.

FIG. 1 illustrates a mineral well 20, specifically an oil well, that comprises a well bore 21 extending downwardly from a surface 22 through an extensive overburden 23, which may include a variety of different formations. Bore 21 of well 20 continues downwardly through a mineral deposit or reservoir 24 and into an underburden formation 25. An electrically conductive casing 26, usually formed of low carbon steel, extends downwardly into well bore 21 from surface 22. Casing 26 may have an external insulator layer 27 from surface 22 down to the upper level of deposit 24. The portion of casing 26 that traverses the deposit or reservoir 24 is not covered by an insulator; it is left exposed to afford a heating electrode 28 that includes a multiplicity of apertures 29 for oil to enter casing 26 from reservoir 24.

Casing 26 and its external insulation 27 may be surrounded by a layer of grout 31. In the region of deposit 24, grout 31 has a plurality of openings aligned with apertures 29 in electrode 28 so that it does not interfere with admission of oil into casing 26. Alternatively, the grouting may be discontinued in this portion of well 20. Below reservoir 24, in underburden 25, a casing section 32 of an electrical insulator such as resin-impregnated fiberglass may be incorporated in series in casing 26. Below the insulation casing section 32 there may be a further steel casing section 33, preferably provided with internal and external insulation layers 34, as described in greater detail in Bridges et al U.S. Pat. No. 4,793,409 issued Dec. 27, 1988, which also discloses preferred methods of forming the insulation layer 27 on casing 26.

Oil well 20, FIG. 1, has an electromagnetic heating system that includes a power source 35 supplied from a conventional electrical supply operating at the usual power frequency of 50 Hz or 60 Hz, depending upon the country in which oil well 20 is located. The heating system for well 20 further comprises the main heating electrode 28, constituting an exposed perforated section of casing 26, and a return electrode shown as a plurality of electrically interconnected conductive electrodes 36 each preferably having plural perforations 36A and each extending a substantial distance into the earth from surface 22. Electrodes 28 and 36 are electrically connected to power source 35.

Power source 35 includes an A.C. to D.C. converter 37 connected by appropriate means to an external 50/60 Hz electrical supply. Converter 37 supplies an intermediate D.C. output to a switch unit 38, preferably a solid state switching circuit, that repetitively samples the D.C. output from the converter at a preselected heating frequency to develop an A.C. heating current that is applied to electrodes 28 and 36. The connection to electrode 28 is made through casing 26, of which electrode 28 is a component part.

Power source 35 additionally comprises a heating rate control circuit 41 that is connected to converter 37 and to solid state switch unit 38. Heating control circuit 41 maintains the sampling rate for the switches in circuit 38 at a frequency substantially different from 50/60 Hz; in well 20, this sampling rate is preferably in a range of 0.01 to 35 Hz. The heating control 41 in well 20 has inputs from one or more sensors. Such sensors may include a temperature sensor 43 and a pressure sensor 44 positioned in the lower part of casing 26 to sense the temperature and pressure of oil in this part of the well. A thermal sensor 45 may be located near the top of the well, as may a flow sensor 46. Control circuit 41 adjusts the power content and frequency of the A.C. heating current delivered from switching unit 38 to electrodes 28 and 36, based on its inputs from sensors such as devices 43–46.

Figure 2:
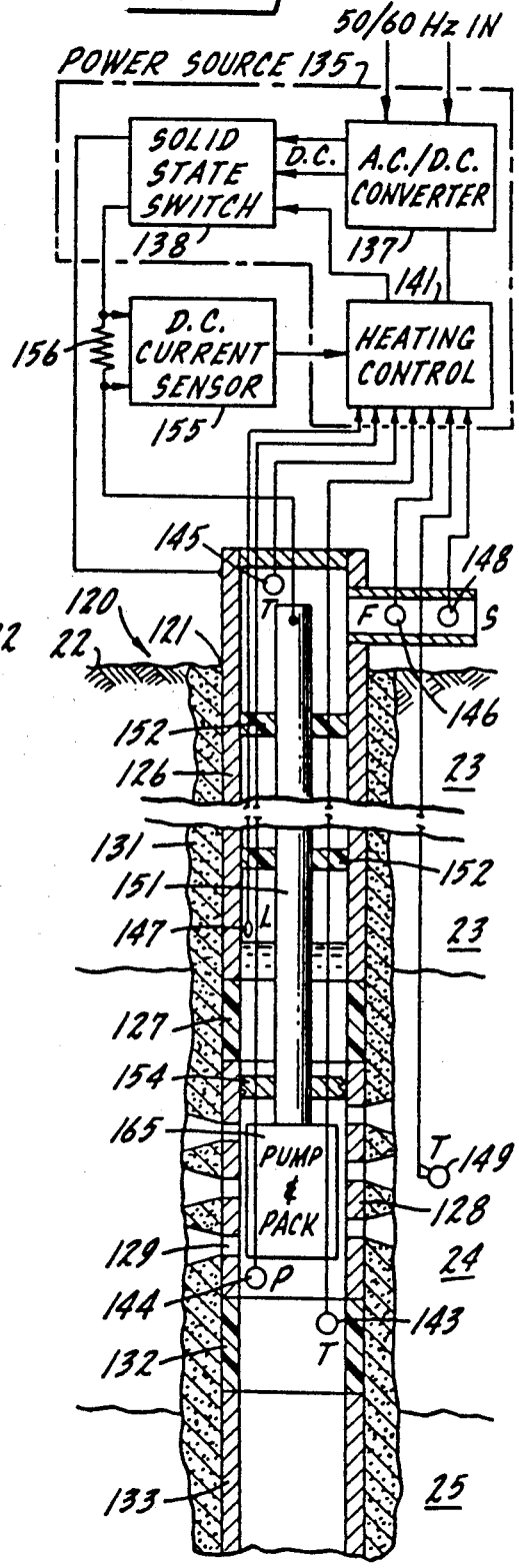

FIG. 2 illustrates another well 120 comprising a well bore 121 again extending down through overburden 23 and deposit 24, and into underburden 25. Well 120 has a steel or other electrically conductive casing 126 which in this instance has no external insulation; casing 126 is encompassed by a layer of grout 131. Electrical conductivity of the well casing is interrupted by an insulator casing section 127 preferably located just below the interface between overburden 23 and mineral deposit 24. A further conductive casing section 128 extends below section 127. Casing section 128 is provided with multiple perforations 129 and constitutes a main heating electrode for heating a part of deposit 24 immediately adjacent well 120. An insulator casing 132 extends into the rathole of well 120, below reservoir 24. The rathole of well 120 may also include an additional length of conductive casing 133, in this instance shown uninsulated.

The heating system for well 120, including its power source 135, is similar to the system for well 20 of FIG. 1, except that there are no separate return electrodes. In well 120, FIG. 2, casing 126 serves as the return electrode and is electrically connected to a solid state switching unit 138 in power source 135. Switching unit 138 is energized from an A.C. to D.C. conversion circuit 137 connected to a conventional 50/60 Hz supply. Power source 135 includes a heating control 141. In this instance, the heating control circuit is shown as having inputs from a downhole temperature sensor 143, a pressure sensor 144, a well head temperature sensor 145, and an output flow sensor 146. A further input to control 141 may be derived from a liquid level sensor 147 in the annulus between casing 126 and a production tubing 151 in well 120. Additional inputs to heating control 141 may be derived from a specific heat sensor 148 shown located in the output conduit from well 120 or from a thermal sensor 149 positioned in deposit 24.

In well 120, the central production tubing 151 extends down through casing 126 to the level of the oil deposit 24. A series of electrical insulator spacers 152 isolate tubing 151 from casing 126 throughout the length of the tubing. Tubing 151 is formed from an electrical conductor; aluminum tubing or the like is preferred but steel tubing may also be used.

Adjacent the top of deposit 24, in FIG. 2, the insulator casing section 127 isolates the upper casing 126 from the main heating electrode 128 of well 120. An electrically conductive spacer and connector 154, located below insulator casing section 127, provides an effective electrical connection from tubing 151 to electrode 128. Connector 154 should be one that affords a true molecular bond electrical connection from tubing 151 to the electrode, casing section 128. A conventional pump and gravel pack 165 may be located below connector 154.

The wells shown in FIGS. 1 and 2 will be recognized as generally representative of a large variety of different types of electromagnetic heating systems applicable to oil wells and to other installations in which a portion of a mineral deposit is heated in situ. Thus, the return electrode for well 20 could be the conductive casing of another oil well in the same field, rather than the separate return electrodes 36. In this specification any reference to the wells and heating systems of FIGS. 1 and 2, should be understood to encompass these and other reasonable variations of the wells and the well heating systems.

As thus far described, the well heating systems of FIGS. 1 and 2 correspond to those described in the co-pending U.S. patent application of J. E. Bridges et al, Ser. No. 322,911 for "Power Sources for Downhole Electrical Heating" filed concurrently herewith. However, each includes additional apparatus used for the control of effective, efficient and economical cathodic protection for the downhole main heating electrodes 28 (FIG. 1) and 128 (FIG. 2). Thus, in FIG. 1 a D.C. current sensor 55 is connected to the electrode energizing circuit, more particularly to a resistor 56 that is connected in series in the circuit connecting solid state switch 38 to casing 26 and hence to main electrode 28. Thus, sensor 55, in conjunction with its shunt resistor 56, monitors the D.C. current flowing in the heating circuit comprising switch unit 38, casing 26, electrode 28, and electrodes 36. The output of sensor 55 is supplied to heating control 41 for use in varying a small negative D.C. bias current to the main electrode 28, as described more fully hereinafter. In FIG. 2 a similar D.C. current sensor 155, using a shunt resistor 156 in the heating circuit connecting switch unit 138 to production tubing 151, provides the same information to heating control 141.

Figure 3:
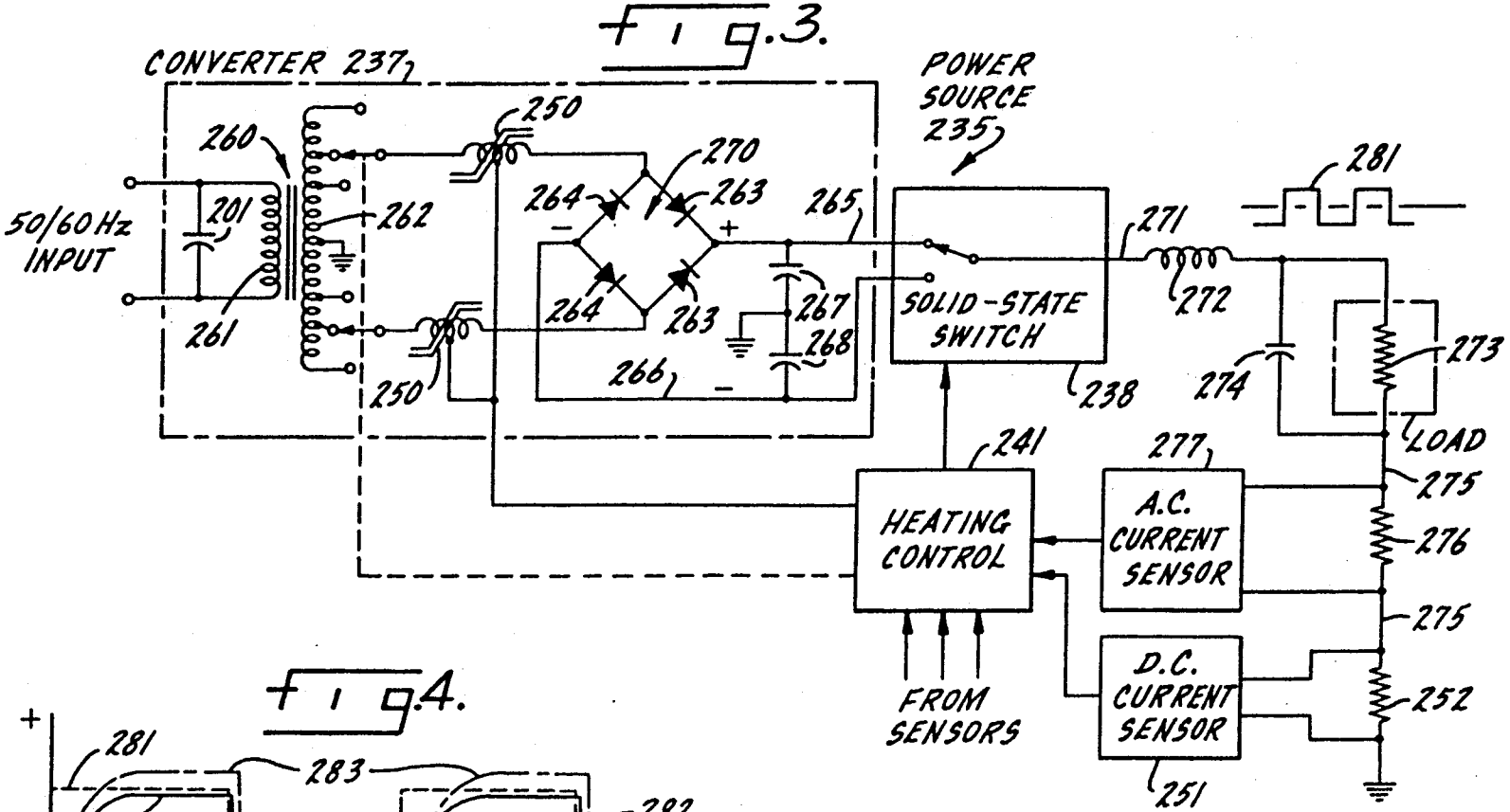
FIG. 3 is a schematic diagram of a simple, single phase electrical energizing apparatus constructed in accordance with one embodiment of the invention.

FIG. 3 illustrates a simple, single-phase power source 235 that may be utilized in the electromagnetic well heating systems of FIGS. 1 and 2, affording the improved cathodic corrosion protection of the present invention. Power source 235 includes an A.C. to D.C. converter 237 that comprises an input transformer 260 having a primary winding 261 connected to an appropriate single phase 50/60 Hz power line input. Transformer 260 has a multi-tapped balanced secondary winding 262, the center of winding 262 being connected to ground. Preferably, a capacitor 201 is connected in parallel with primary winding 261 for power factor correction and for suppression of harmonics that might otherwise be reflected back into the power line supplying transformer 260.

Power source 235 further comprises a rectifier bridge circuit 270 including two forwardly polarized diodes 263 and two reverse polarized diodes 264. Each of the tap selectors on the secondary winding 262 of transformer 260 is connected to one of the input terminals of bridge 270. On the output side of bridge 270, the cathodes of diodes 263 are connected together to a positive polarity output line 265 that is connected to a solid state switch unit 238. Similarly, the anodes of bridge diodes 264 are connected together and to a negative conductor 266 that is also connected to the solid state switch unit. A pair of filter capacitors 267 and 268 are connected from conductors 265 and 266, respectively, to ground. Preferably, a pair of saturable reactors 250 are connected between bridge 270 and the taps on transformer 260. Switch unit 238 may include any desired form of switching apparatus (preferably solid state) that is capable of handling the high amplitude A.C. currents, frequently in the range of 50 to 1000 amperes, necessary for effective electromagnetic heating of an oil well or other mineral well. Thus, the switching components used in unit 238 (not shown in detail) may comprise gated turnoff (GTO) thyristors or power transistors. It may be necessary to use a plurality of such switching devices in parallel or in series in order to provide adequate current-carrying capacity or voltage withstand capability for switch unit 238. Of course, it will be recognized that it may also be necessary to afford a plurality of diodes, in series or in parallel with each other, in each polarity, to obtain adequate capacity in bridge 270 of converter 237.

The output conductor 271 from solid state switch unit 238 is connected through a frequency limiting inductance 272 to a load, shown in FIG. 3 as a resistance 273. Load 273 represents the heating energy conductors, the main heating electrode, the return electrode, and intervening heated formations in the heating systems for the oil wells as previously described. Thus, load 273 represents the overall impedance of casing 26, main heating electrode 28, electrodes 36, and the formations between the electrodes in well 20 of FIG. 1. Similarly, for FIG. 2 load 273 of FIG. 3 represents the total impedance of tubing 151, connector 154, main heating electrode 128, casing 126 (serving as the return electrode) and the formations between electrodes 128 and 126. It should be noted that resistance 273 is not constant; it is a non-linear resistance that may vary substantially. Of course, the heating circuit in each instance may include some capacitance, shown as a capacitor 274 connected in parallel with load 273. Additional capacitance may be provided to limit application of undesired high frequency energy to load 273, with resultant unwanted losses.

The load circuit 272–274 for switch unit 238 is returned to ground by a conductor 275. A low resistance shunt 276 may be connected in series in conductor 275, serving as the input to an A.C. heating current sensor 277. The output of A.C. current sensor 277 is supplied to a heating control circuit 241 that is utilized to control the frequency and duty cycle for the solid state switches included in switch unit 238 and that also controls the taps on the secondary winding 262 of transformer 260 in converter 237. An output from heating control 241 is also connected to reactor 250. Heating control circuit 241 should also be provided with inputs from the temperature sensors in the oil well, such as sensors 43–46 in FIG. 1 and sensors 143–149 in FIG. 2.

Power source 235, FIG. 3, affords an inexpensive but reliable power source for an electromagnetic oil well heating system. Electrical energy derived from the 50 or 60 Hz conventional power supply, through transformer 260, is rectified in the bridge 270 of converter 237; the output from the conversion circuit is smoothed by filter capacitors 267 and 268. Thus, the filtered output from converter 237 is supplied with a positive polarity (line 265) and a negative polarity (line 266) to the solid state switch 238. The main heating electrode in the deposit in the well, such as electrode 28 of FIG. 1 or electrode 128 of FIG. 2, is alternately switched to the positive polarity and the negative polarity by switch unit 238 at a frequency determined by appropriate circuits, including a local oscillator, in heating control 241; in wells like those of FIGS. 1 and 2 a low frequency, as in a range of 0.01 to 35 Hz, is preferred because it affords a material improvement in efficiency by greatly reducing eddy current and hysteresis losses in casing 26 (FIG. 1) and in casing 126 and tubing 151 (FIG. 2). Energization of the heating circuit is effected by an A.C. square wave 281 as shown in FIG. 3 and as shown in idealized form by the dash line representation 281 in FIG. 4. The series inductance 272 is effective to suppress high frequency components of the square wave, affording a waveform of high purity at about ten Hz.

Figure 4:
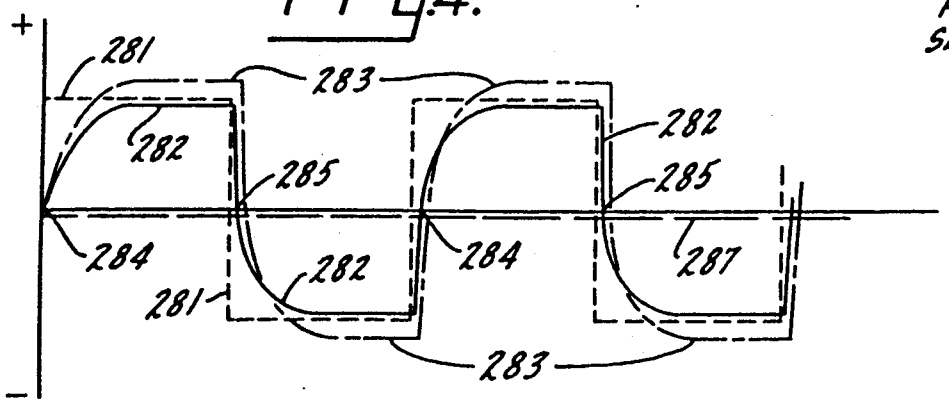
FIG. 4 is an electrical waveform diagram used in explanation of FIG. 3.

In FIG. 4, the solid line curve 282 affords a more realistic representation of the waveform of the A.C. heating current to load 273 in power source 235, FIG. 3. As shown by curve 282, in each half cycle the heating current increases rapidly when the switching device or devices in unit 238 are driven to ON condition for a given polarity. When the current reaches a peak level it stays at that level until the end of the half cycle, then decreases rapidly and begins the buildup of current of the opposite polarity.

One way to adjust the heating rate for the system represented by load 273 in FIG. 3 is to vary the setting of the output taps for transformer secondary 262. One such change, to an increased power level, is shown in FIG. 4 by the phantom line curve 283. Multiple changes of this sort can be provided by appropriate construction of transformer 260. These power level changes may be controlled by heating control 241, as shown in FIG. 3; in many instances, adequate control is afforded if unit 241 merely correlates the input data from its sensors and transformer tap changes are made manually based on a readout from control 241. The heating control also applies a saturation current to reactors 250 to control the heating rate over a limited range of a lagging power factor. By proper choice of capacitor 201 and reactors 250, the power factor can be kept within acceptable limits as prescribed by the power company.

In power source 235, FIG. 3, sensor 277 monitors the main A.C. heating current; this information, together with the data from thermal sensors (43, 45, 143 or 145), flow sensors (46,146), and the like, affords the basis for principal control of switch unit 238 by control 241, maintaining the heating rate at an optimum level for well performance. But heating control 241 is also constructed so that it can provide a minor asymmetry in the square wave A.C. output to load 273, maintaining the downhole main heating electrode (28 or 128) at a neutral potential or a small negative potential relative to the return electrode (36 or 151). In the process, switching unit 238 should always afford a connection from conductor 271 to one of the positive and negative polarity lines 265 and 266. This procedure develops a small, closely controlled D.C. current, in the heating circuit, that is the basis for corrosion protection of the main heating electrode.

Referring to FIG. 4, in each cycle of the A.C. heating current 282 or 283 the initiation points 284 for the positive half cycles may be slightly delayed as compared to the initiation points 285 for the negative half cycles. Thus, there is a slightly smaller current in each positive half cycle, as compared to the corresponding negative half cycle. The overall result is a small average net D.C. bias current, shown by line 287. The amplitude of the D.C. bias current 287 is much exaggerated as compared to the A.C. heating current 282 or 283; the A.C. heating current is usually in a range of 50 to 1000 amperes whereas the D.C. bias current should be in the milliampere range, or at most no more than about one ampere. Indeed, the net D.C. voltage differential between the electrodes (e.g., 28 and 36 in FIG. 1 or 128 and 151 in FIG. 2) should be of the order of one volt, or even less, at all times. As previously noted, the A.C. waveforms 282 and 283 should be continuous at all times.

To control the D.C. corrosion protection current (287, FIG. 4) power source 235, FIG. 3, is provided with a D.C. current sensor 251 connected to an additional lowresistance shunt 252 in series in the load circuit. Sensor 251 provides heating control 241 with an input signal indicative of the D.C. bias current in the load circuit. Control 241 uses this input to control the small difference in duration of the positive and negative half cycles of the A.C. heating current so that a very small D.C. bias is maintained. This corrosion-protection bias is usually in the milliampere range, as contrasted to the hundreds of amperes of A.C. heating current.

Figure 5:
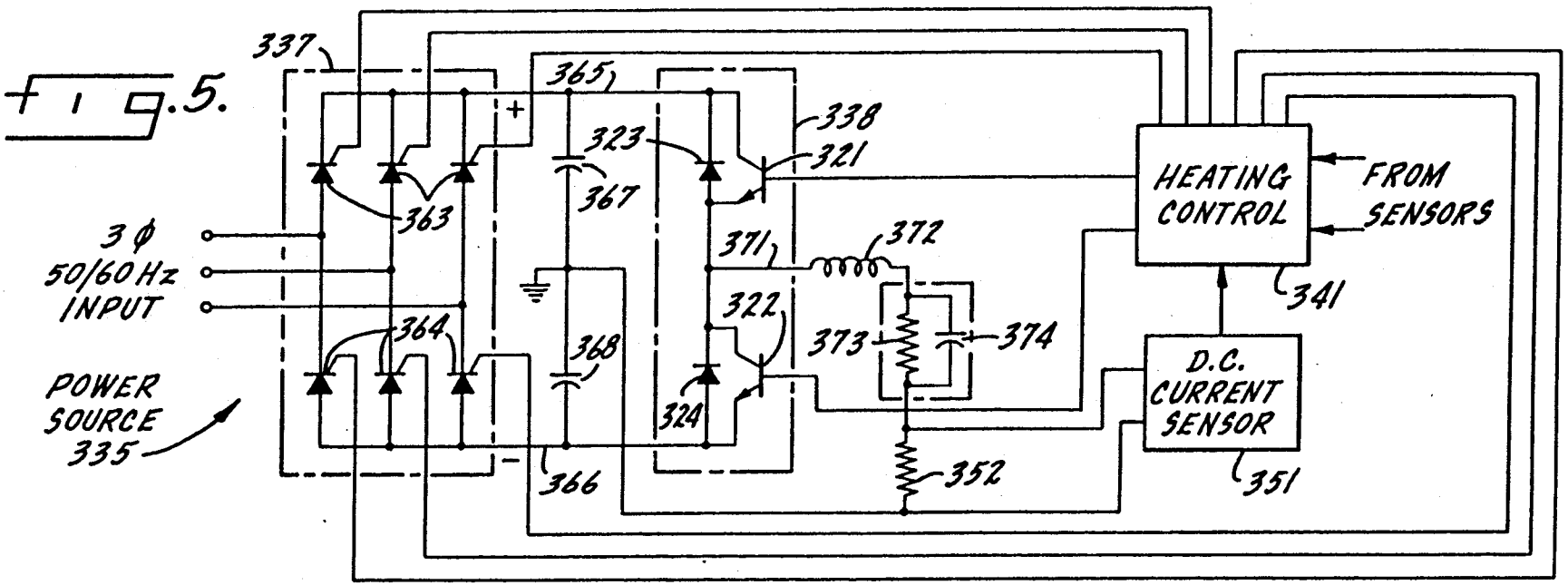
FIG. 5 is a circuit schematic for another electrical energizing apparatus in accordance with the present invention.

FIG. 5 illustrates another power source 335 that may be utilized in the heating systems of wells such as those of FIGS. 1 and 2. Power source 335 constitutes a pulse width modulation (PWM) inverter, corresponding to a type of circuit that has been utilized in variable speed electronic motor drives. It includes an A.C. to D.C. converter circuit 337 having three forwardly polarized SCRs 363 each having its anode connected to one lead of a three phase 50/60 Hz input. Converter 337 further comprises three oppositely connected SCRs 364, connected to the same A.C. supply lines. A positive output conductor 365 for the converter is connected to the cathodes of all of the SCRs 363. Similarly, a negative output conductor 366 is connected to the anodes of the reverse polarity SCRs 364. It will be recognized that the current-carrying capacity of converter 337 may be increased by the use of additional SCRs in parallel with devices 363 and 364; the voltage withstand capacity of the converter can be increased by further SCRs in series with devices 363 and 364. A filter capacitor 367 is connected from the positive polarity output line 365 to ground; similarly, a filter capacitor 368 is connected from conductor 366 to ground.

The solid state switching circuit 338 in power source 335, FIG. 5, comprises two ON/OFF power transistors (or GTO thyristors) 321 and 322. The collector of transistor 321 is connected to the positive polarity output conductor 365 from conversion circuit 337. The emitter of transistor 321 is connected to a frequency-limiting inductance 372 that is in turn connected to a load impedance 373 representing the overall impedance of the main heating circuit in one of the oil wells. A capacitance 374 connected in parallel with load 373 may be considered to represent the inherent capacitance of the heating system; additional capacitance may be desirable. Load impedance 373 is returned to ground through a low sensing resistor 352, the ground connection being shown as made at the junction of filter capacitors 367,368. A diode 323 is connected across the emitter and collector of transistor 321. The circuit connection for power transistor 322 is similar to that of transistor 321. In this instance, the emitter is connected to the negative conductor 366 in the output from rectifier 337 whereas the collector is connected to the load circuit comprising inductance 372 and load 373. A diode 324 is connected across the collector and emitter of transistor 322.

Power source 335 includes a heating control circuit 341 having appropriate connections from sensors such as the thermal sensors 43–46 and 143–149 of FIGS. 1 and 2 respectively. Heating control circuit 341 has output connections to the bases of the two ON/OFF power transistors 321 and 322 and to the gate electrodes of all of the SCRs 363 and 364 in converter circuit 337.

Figure 6B:
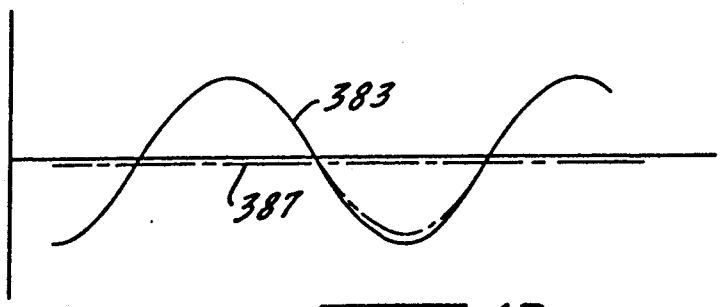
FIGS. 6A and 6B are electrical waveforms used in explanation of operation of the circuit of FIG. 5.
Figure 6A:
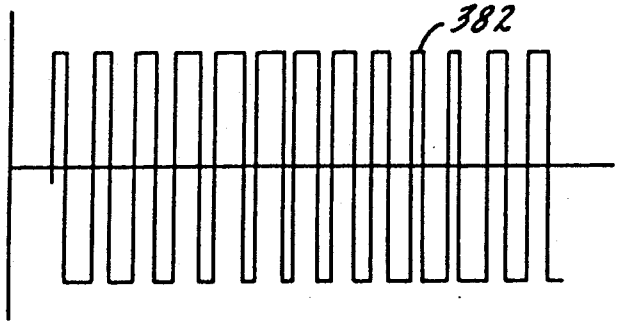

The output of power source 335, as it appears on conductor 371, corresponds generally to the waveform 382 in FIG. 6A. That is, the output of the circuit of FIG. 5 is a pulse width modulated (PWM) square wave generated by the ON/OFF power transistors 321 and 322. Similar outputs can be developed by switching circuits that use GTO thyristors or other such solid state switching devices. Power source 335 is relatively efficient, at least in comparison with audio amplifier circuits. Furthermore, its output waveform 382 can be proportionally controlled by varying the timing of the gating signals supplied to transistors 321 and 322. The output is effectively integrated or filtered to provide the low frequency wave component illustrated by the idealized curve 383 in FIG. 6B. The conductive angles of the SCRs 363 and 364 in converter 337 can be varied, by control 341, to change the amplitude of the output waveform 382 to meet changes detected by the sensors connected to the control circuit.

Power source 335, however, can be relatively expensive and may generate significant subharmonics that are transferred back into the power line from which source 335 is energized. Such subharmonics can cause flicker and otherwise disrupt operations of typical rural power systems. Accordingly, effective use of power source 335 may be dependent upon incorporation of adequate filter circuits (not shown) to minimize the subharmonic difficulties.

In power source 335, heating control 341 is constructed to afford a slight asymmetry in the PWM waveform 382, so that the negative-going half cycles of curve 383, FIG. 6B, have a slightly greater amplitude than the positive half cycles. This may be done by having the dwell time longer for one polarity, usually negative as illustrated. The end result is a very small average D.C. bias 387, FIG. 6B, polarized for corrosion protection of the downhole main heating electrode that is a major component of load 373, FIG. 5.

As before, the average D.C. corrosion protection current should be kept to a very low level, preferably in the milliampere range, or at least no more than one or two amperes, as contrasted with an A.C. heating current of hundreds of amperes. Effective control of the bias current, to extend the well life of all of its components, and particularly any "sacrificial" return electrodes (e.g. 36, FIG. 1) is afforded by a D.C. current sensor 351 connected to the shunt resistance 352 in series with the main heating circuit; as before, the D.C. bias current sensor output is supplied to heating control 341 to enable that control to maintain a minimum bias current.

Figure 7:
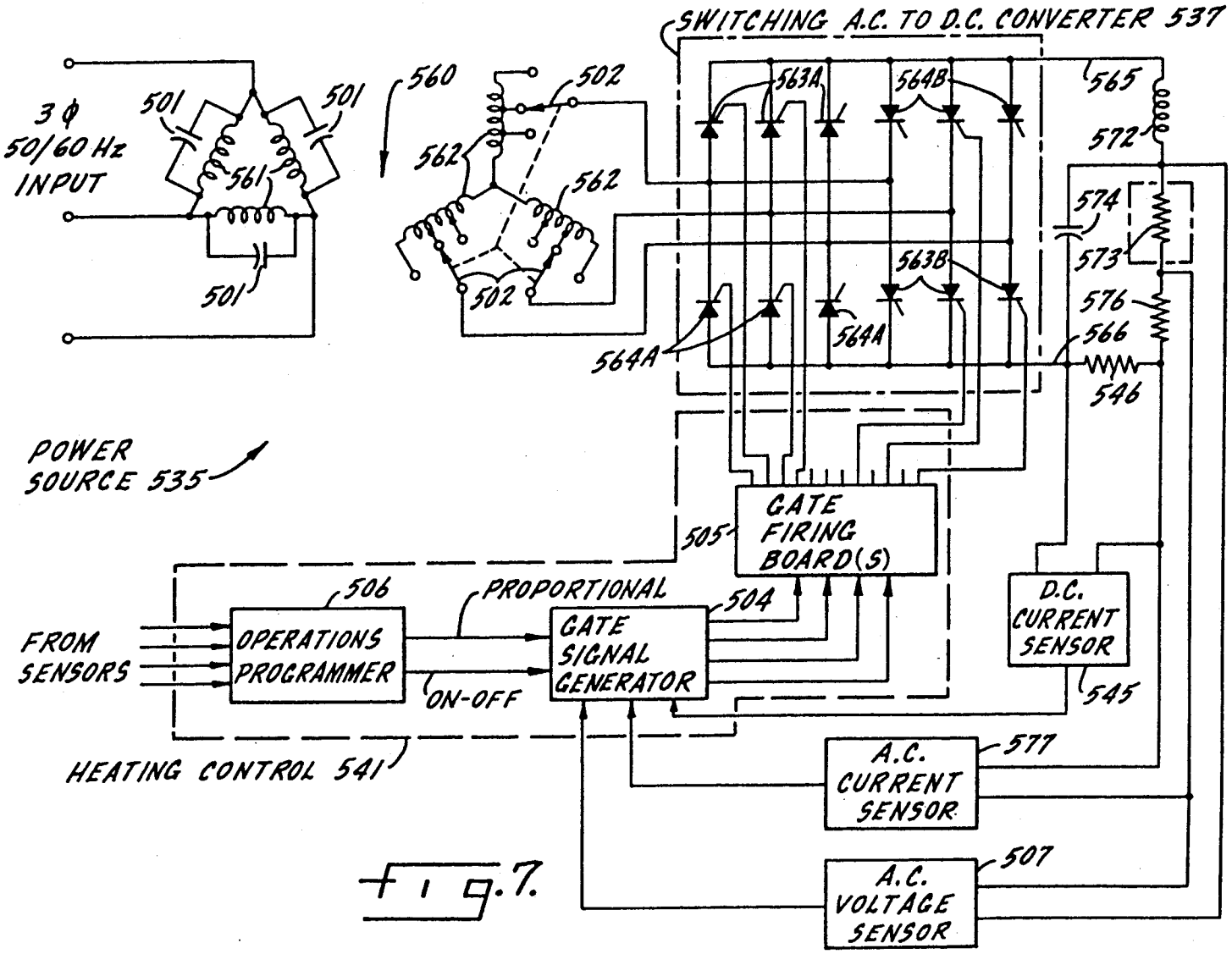
FIG. 7 is a schematic circuit diagram, partly in block form, of another energizing circuit in accordance with the invention.

FIG. 7 illustrates a power source 535 that constitutes a preferred construction for many applications in which the heating system for an oil well or other comparable installation is to be energized at a frequency significantly lower than the conventional power line frequencies of 50/60 Hz. power source 535 is supplied from a three phase 50/60 Hz power line by means of an input transformer 560 having three delta connected primary windings 561 and three wye connected secondary windings 562. On the primary side of transformer 560 there is a capacitor 501 connected in parallel with each primary winding 561. Each secondary winding 562 of the transformer, on the other hand, is provided with a tap changer 502. The three tap selectors 502 are all interconnected mechanically for simultaneous adjustment.

A circuit 537 in power source 535 combines the functions of an A.C./D.C. conversion means and a solid state switching means. Circuit 537 is of a type known as a cyclo-converter; it includes three signal-controlled rectifiers 563A having their anodes individually connected to the cathodes of three other SCRs 564A. Unit 537 further includes three additional positively polarized SCRs 563B individually connected, anode-to-cathode, to three other reverse polarized SCRs 564B. Each output tap 502 of transformer 560 is connected to the anode-cathode terminal of one SCR pair 563A and 564A and is also connected to the anode-cathode terminal of another SCR pair 563B and 564B.

The output of circuit 537, like the previously described power sources, comprises two conductors 565 and 566; in this instance, however, neither can be characterized as a positive polarity bus or a negative polarity bus. Instead, both conductors go positive and negative, though at different times. Conductor 565 is connected to the cathodes of all of the SCRs 563A and to the anodes of all of the devices 564B; conductor 566 is similarly connected to the SCRs 563B and 564A. The load circuit of the heating system is connected across the output conductors 565 and 566 of the combined rectifier and switching circuit 537; the load circuit includes a frequency limiting inductance 572 in series with a load 573 shown as a resistance and representative of the electrodes and connecting portions of the heating circuit in any of the previously described oil wells. A shunt capacitor 574 is shown connected across load 573, as a part of the overall load circuit; capacitor 574 represents the inherent capacitance of the load, which may be supplemented by additional capacitance to minimize application of higher harmonics to the main load impedance 573. A resistance 576 is shown in the load circuit, serving as an input to an A.C. average current sensor 577; another resistance 546 affords an input to a D.C. current sensor 545.

Current sensor 577, which is essentially equivalent to a conventional A.C. ammeter, supplies an output to a gate signal generator 504 that is a part of the heating control 541 of power source 535. Gate signal generator 504 is connected to a gate firing board or boards 505 having a multiplicity of outputs, one for each of the gate electrodes of SCRs 563A, 563B, 564A, and 564B. Gate signal generator 504, in addition to its input from the A.C. current sensor 577, has additional inputs derived from an operations programmer 506 that receives inputs from appropriate temperature and flow sensors (e.g. sensors 143–149, FIG. 2). Gate signal generator 504, as shown in FIG. 7, also receives input signals from the D.C. current sensor 545 and from an A.C. voltage sensor 507 that is connected across load impedance 573. A D.C. current sensor 545, connected to an appropriate low resistance 546 in the heating circuit, may also afford an input to gate signal generator 504 for control of a low-amplitude corrosion inhibition current.

At the input to power source 535, each capacitor 501 serves as a part of a power factor correction circuit. The tapped secondaries 562 of input transformer 560 afford a convenient and effective means for major adjustments of the power supplied to the load circuit 572–574 energized from the power source. The SCRs in the A.C./D.C. conversion unit 537 are connected in a complete three-phase switching rectifier bridge that supplies positive and negative-going power to both of the conductors 565 and 566; the SCRs are fired in sequence, in a well-known manner, under control of gate firing signals from circuit 505 of heating control 541.

Figure 8A:
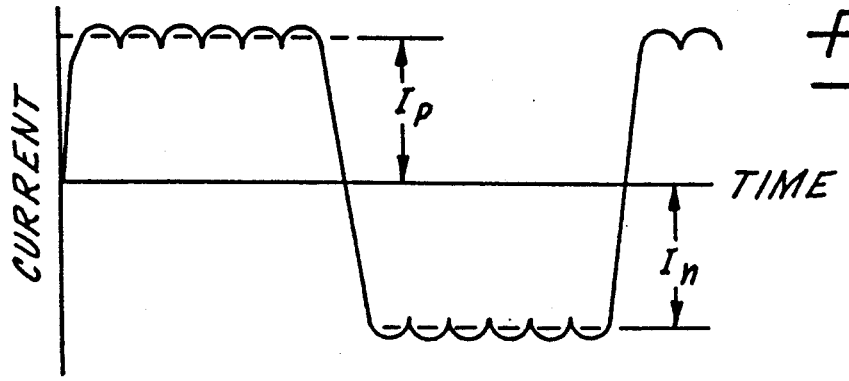
FIGS. 8A–8C are electrical waveform diagrams utilized in explanation of the operation of the apparatus of FIG. 7.

Power source 535 supplies heating power to load 573 with a waveform 510 approximating that of a square wave, as illustrated in FIG. 8A. The positively polarized SCRs 563A and 563B supply the positive portions of the square wave signal, being fired to develop that portion of the electrical power supplied to the load, whereas the negative SCRs 564A and 564B are fired to produce the negative portions of waveform 510. The ripple in waveform 510 is from the 50/60 Hz input.

Figure 8B:
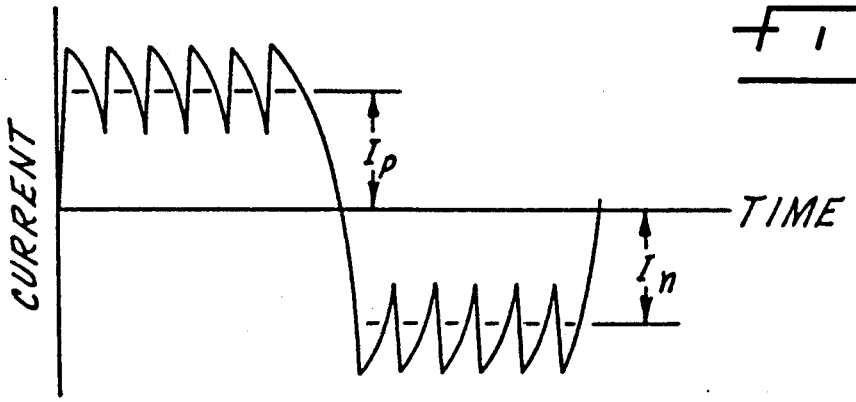

By delaying the firing of the positive-going SCRs 563A and 563B, the amplitude of the positive portion of waveform 510 can be modified and the positive-going current $I_p$ can be reduced in amplitude as shown in FIGS. 8B, waveform 511. Similarly, by delaying the firing of the negative-going SCRs 564A and 564B, the amplitude $I_n$ of the negative portions of the pseudo square wave can be reduced, particularly as shown by the negative half cycle of waveform 511 in FIG. 8B. Symmetrical alteration of the timing of firing of the SCRs provides effective proportional duty cycle control, reducing the overall amplitude of the pseudo square wave as supplied to load 573 and thus reducing the power applied to downhole heating.

The timing of the firing signals supplied from circuit 505 to the SCRs in rectifier 537 is controlled from gate signal generator 504, in turn controlled by the operations programmer circuit 506, which can select either proportional duty cycle control or ON/OFF (bang-bang) control for the SCRs. When the latter expedient is selected by circuit 506, the heating rate control is limited to that afforded by the adjustable taps 502 on the secondary windings of transformer 560. Operations programmer 506 may be made responsive to various sensors, including sensors located at the top of the well and/or other sensors positioned downhole of the well in the immediate vicinity of the main heating electrode; see suggested sensor locations in FIG. 2. The sensor inputs to programmer 506 are employed, particularly when proportional control is being exercised, to maintain the operating temperature of the main heating electrode and/or the deposit within appropriate limits in order to maximize electrode life and preclude unwanted side effects due to excessive temperatures.

Figure 8C:
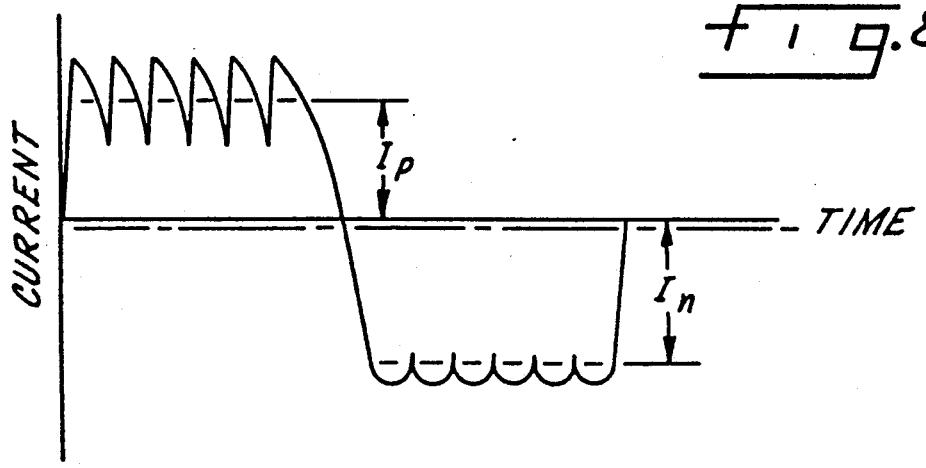

To achieve an effective anti-corrosion D.C. bias on the downhole main heating electrode, using the cyclo-converter power source 535 of FIG. 7, asymmetrical control of the firing of the positively and negatively polarized SCRs may be employed, with a waveform 512A, 512B as illustrated in FIG. 8C. Thus, the firing of the positive-going SCRs 563A and 563B may be delayed, reducing the average amplitude $I_p$ of the positive half cycle 512A of the waveform. If there is no delay, or at least less delay, the average amplitude $I_n$ of the negative half cycle 512B is greater than $I_p$, providing usable and effective cathodic corrosion protection for the downhole main heating electrode, assuming the resultant D.C. current 513 (FIG. 8C) is in the appropriate direction with the main electrode at a net average negative potential relative to the return electrode. The D.C. corrosion-inhibiting current 513 is continuously monitored by sensor 545, FIG. 7, and should be maintained at a very low amplitude, below one ampere.

Figures 9, 9A, 9B:
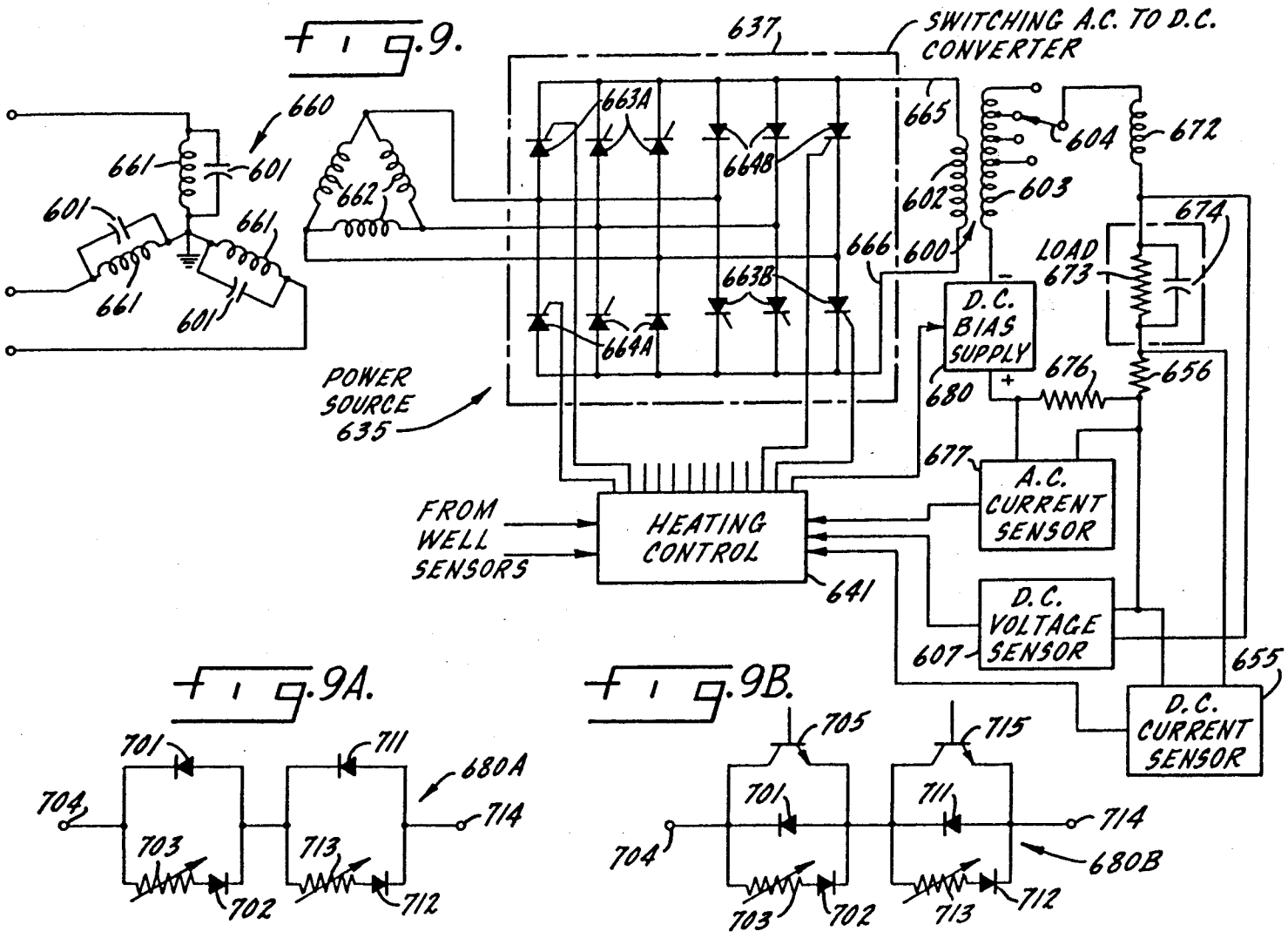
FIG. 9 is a circuit diagram of another electrical energizing circuit operable in accordance with the invention.
FIGS. 9A and 9B are detail diagrams of alternate forms of one of FIG. 9.

FIG. 9 illustrates another power source 635 that may be utilized to carry out the apparatus and method objectives of the present invention. The circuit of power source 635 includes an input transformer 660 of the wye-delta type, with power factor correction capacitors 601 connected in parallel with the input windings 661. The output windings 662 are connected to a combined A.C./D.C. converter and switching unit 637 utilizing both positively polarized SCRs 663A and 663B and negatively polarized SCRs 664A and 664B in a cyclo-converter circuit like that of FIG. 7, with two output conductors 665 and 666.

In power source 635 the output lines 665 and 666 from switching rectifier unit 637 are connected to the primary winding 602 of an output transformer 600. The secondary winding 603 of transformer 600 is equipped with a tap changer 604 to provide major changes in the amplitude of the heating current supplied to the output circuit, comprising a current limiting coil 672, a load resistance 673, and a capacitance 674. As before, load 673 represents the casing or other conductive means for supplying an A.C. heating current to a downhole main heating electrode, that heating electrode, the return electrode, and the portions of intervening earth formations between the two electrodes. As in any and all of the systems that use steel pipe, the load resistance 673 may be quite non-linear.

Power source 635 is a cyclo-converter substantially similar, in many respects, to circuit 535 of FIG. 7. It includes a heating control 641 that supplies firing signals to the gate electrodes of all of the SCRs in switching rectifier circuit 637. Heating control 641 has inputs from appropriate temperature sensors, flow sensors, and/or pressure sensors in the well and may be connected to an external computer if utilized in conjunction with other similar power sources at different wells. It also includes an A.C. current sensor 677 connected to a shunt resistance 676 in the heating circuit; the output of sensor 677 is supplied to heating control 641. A D.C. voltage sensor 607 may be connected across load 673, with its output also applied to heating control 641. A shunt resistor 656, in series in the heating circuit for the well, is connected to a D.C. current sensor 655. The output of sensor 655 is applied to heating control 641.

The operation of the cyclo-converter power source 635 of FIG. 9 is essentially similar to that of circuit 535 of FIG. 7, including the waveforms illustrated in FIGS. 8A and 8B. The principal difference is that major changes in the heating current supplied to load 673 are achieved by tap changer 604 in the secondary of the output transformer 600 (FIG. 9) rather than by the tap changers 502 on the secondary of input transformer 560 (FIG. 7). The other principal difference is that the presence of output transformer 600 in the circuit precludes effective development of a corrosion inhibiting D.C. bias on load 673 through control of the gating signal supplied to the SCRs in switching rectifier circuit 637. Instead, a separate D.C. bias supply 680 is included in the heating circuit comprising load 673.

Utilizing conventional cathodic protection apparatus, D.C. bias supply, 680 might include an A.C. powered separate D.C. bias supply or it might comprise a polarization cell. But the use of either of these two expedients, employing apparatus of the kind usually used in cathodic protection arrangements for pipelines and oil wells, is quite difficult, to the extent of being impractical or in some instances even impossible.

A conventional A.C. powered D.C. bias supply, having a controllable D.C. voltage or current output, might be utilized as D.C. bias supply 680 of FIG. 9. But equipment of this kind as customarily used in the oil industry cannot withstand continuous operation at the levels of A.C. current required for load 673 which, as previously noted, are usually in the range of 50 to 1000 or more amperes at frequencies of 0.01 to 35 Hz. Thus, the electrolytic capacitors normally used in such A.C. powered D.C. bias supplies cannot withstand such high A.C. currents, at these low frequencies, without highly deleterious effects on their reliability and operation. As a consequence, substantially more expensive capacitors must be used and other design revisions are also likely to be required. The conventional A.C. powered D.C. bias supply, when modified for the circuit of FIG. 9 as device 680, is too expensive to be economically practical.

Theoretically, a conventional polarization cell might be inserted in the circuit of FIG. 9 as the D.C. bias supply 680. Such a cell operates to inhibit corrosion by building up a polarity opposite to that generated by naturally occurring D.C. currents. In many installations, it is capable of developing a neutralizing potential that offsets the naturally occurring D.C. currents causing corrosion. Again, however, the use of polarization cells employing presently available constructions poses substantial difficulties.

A polarization cell of conventional construction, while designed to withstand heavy surges of current and voltage such as those derived from lightning, cannot withstand a continuous A.C. current, at the levels required for heating load 673, without appreciable evaporation of the electrolyte that is an integral and essential part of the polarization cell. Consequently, a substantially larger and more complex cell, of a construction as yet not fully ascertainable, would have to be used as D.C. bias supply 680. It appears that such a cell would be so expensive as to mitigate against its use, economically, as the D.C. bias supply in the circuit of FIG. 9.

FIG. 9A illustrates a relatively simple and inexpensive circuit 680A that may be employed is the D.C. bias supply in power source 635, FIG. 9, or in other oil well heating system power sources that utilize output transformers. Circuit 680A, which has input/output terminals 704 and 714, includes two diodes 701 and 702 connected in parallel with each other and in opposite polarities. An adjustable resistor 703 may be connected in series with one of the diodes, in this instance diode 702. The circuit 701–703 is connected in series with a further circuit of a diode 711 in parallel with a diode 712; an adjustable resistor 713 is shown in series with diode 712.

In bias supply 680A, diodes 701 and 711 are selected to have substantially different band-gap energies from diodes 702 and 712. For example, if diodes 701 and 711 are both germanium or Schottky diodes, and diodes 702 and 712 are both silicon diodes, this condition is met. The forward voltage drop across each of diodes 701 and 711 will then be approximately 0.2 volts, whereas the forward voltage drops across each of diodes 702 and 712 is about 0.8 volts. This produces a net differential of approximately 1.2 volts D.C. across terminals 704 and 714 of circuit 680A, due to the A.C. currents flowing in that circuit when it is employed in a heating circuit as a D.C. bias supply in the manner shown in FIG. 9. This is a voltage level quite suitable for cathodic protection of the main downhole electrode that is a part of load 673. Resistors 703 and 713 are provided simply to permit adjustment of the overall bias; by changing these resistances, the bias can be adjusted to meet operating requirements. I should be understood that resistors 703 and 713 may be signal-variable resistances, actuated by a control signal from heating control 641 or directly from an appropriate circuit for determining the net D.C. current in the heating loop that includes load 673, all as a part of bias supply 680. The positions of the variable resistances 703 and 713 can be changed; they could equally well be in series with diodes 701 and 711. The net bias current can also be changed by control of the temperatures of the diodes in circuit 680A.

Variable control of the D.C. bias current can also be achieved by paralleling diodes 701 and 711 with two transistors 705 and 715 as shown in FIG. 9B. During each cycle of the A.C. heating current, terminal 704 will at one time be driven positive relative to terminal 714. At this point diodes 701 and 711 do not conduct, but diodes 702 and 712 are conductive. The voltage between terminals 704 and 714 is a function of the resistances 703 and 713 and the forward saturation voltages of diodes 702 and 712. By adjusting these values, sufficient voltage can be developed to permit transistors 705 and 715 to function as variable resistances. By varying the emitter input currents to transistors 705 and 715, the amplitudes of the currents which are shunted away by these transistors, and which would otherwise pass through circuit elements 702, 703, 712 and 713, can be varied. The base drive currents for transistors 705 and 715 may be derived from a D.C. current sensor like sensor 545, FIG. 7. Other effective D.C. bias sources, utilizing the same operating principles as FIGS. 9A and 9B, are described and claimed in the co-pending appliation of J. E. Bridges et al, Ser. No. 322,912, filed concurrently herewith now U.S. Pat. No. 4,919,201.

Figure 10:
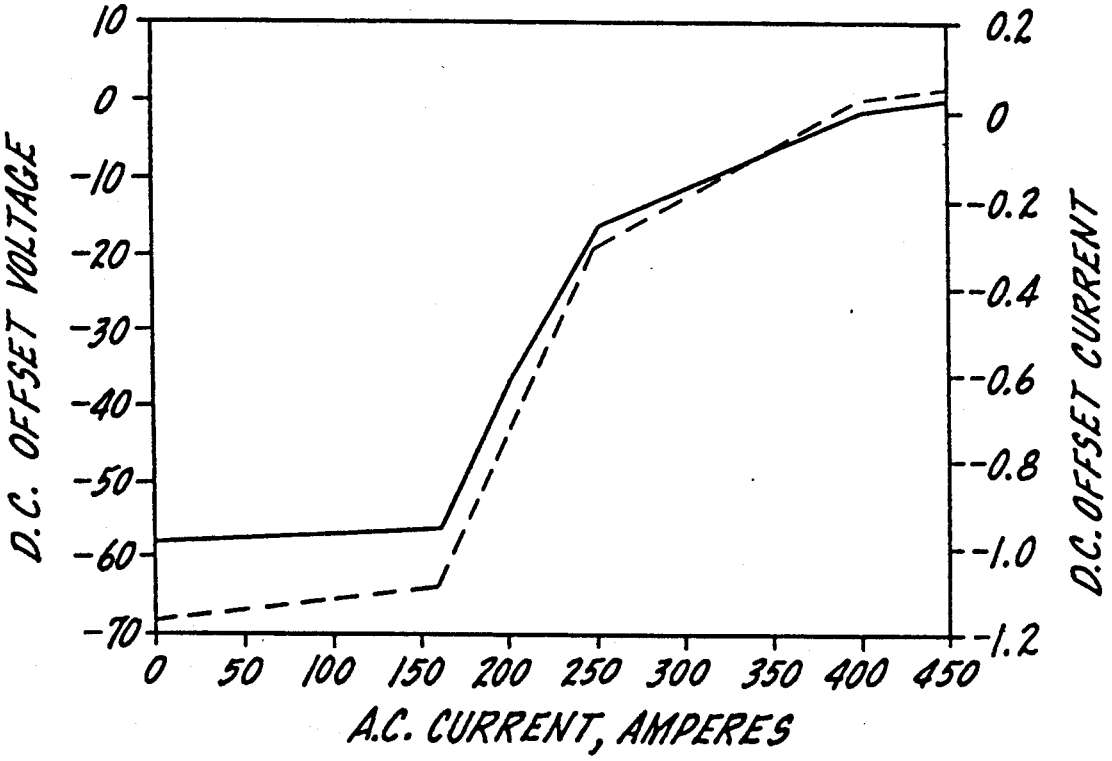
FIG. 10 is a chart of D.C. current variations responsive to changes in A.C. heating current.

For a more complete understanding of the method and apparatus of the present invention, consideration of the electrical phenomena that occur in an electromagnetic heating system for an oil well or other mineral fluid well, of the kind including a main heating electrode deep in the well and a return electrode remote from the main heating electrode, is desirable. FIG. 10 illustrates the D.C. voltage and D.C. current between a downhole main heating electrode, in a system of this kind, and each of two return electrodes. In this instance, each return electrode was the casing of an adjacent oil well. With no A.C. heating current in the system the first circuit, curve 801, had a D.C. offset voltage of about −58 millivolts and a D.C. current just under one ampere. The current in the other system, curve 802, again with no applied A.C. heating current, showed a voltage differential of approximately −68 millivolts and a current of nearly 1.2 amperes. These naturally induced voltage differentials and currents arise because of different characteristics in the metal, the electrolytes, and temperatures between the main electrode in the well under study and the return electrodes.

In the wells from which FIG. 10 was obtained, the D.C. offset current of each return electrode decreased as the A.C. heating current increased, over a range of zero to 450 amperes. However, it is equally likely that the D.C. offset current would increase, as to two or three amperes, in response to application of increasing A.C. heating excitation currents. Whether or not the D.C. offset current (and voltage) is increased or decreased in response to the A.C. heating current depends upon the materials used for the electrodes and on the electrolytes in the immediate vicinity of each of the electrodes. It should also be noted that the amplitude of the A.C. current required for well heating is a function of the flow rate of fluids from the deposit or reservoir into the well. The flow rate, and hence the heating current demand, changes appreciably over extended periods of time, and precludes the effective use of a fixed cathodic or current neutralization bias.

In considering the features and requirements of the invention, it may also be noted that use of high negative cathodic protection potentials may result in the accumulation of excessive scale on the main electrode, in this instance the main heating electrode deep in the well a the level of the mineral reservoir. An excessive accumulation of scale around the main heating electrode may plug up the perforations in that electrode or may block the screens present in many wells. The scale is also likely to interfere with electrical operation of the electrode. Thus, to achieve the full benefits of the present invention it is important to adjust the D.C. bias in accordance with changing conditions, in and around the well, to keep the D.C. corrosion protection current at a minimum. When this is done, excessive corrosion of the return electrodes is avoided, scale accumulation on the downhole main heating electrode is minimized, and well life is prolonged.

For further background, the situation of two widely separated electrodes embedded in the earth may be considered in relation to the cathodic protection concepts of the invention. Typically, the formations around each electrode have different chemical constituents; the electrode lengths are also likely to be substantially different. Under these circumstances, due to differences in lengths and in the encompassing chemical constituents, a D.C. potential is developed between the two electrodes. When these two electrodes are connected at one end only, a D.C. current flows through the interconnection, the return path being the earth formations. This is the situation for zero A.C. current in FIG. 10. Of course, this causes one of the electrodes to be positive and the other to be negative with respect to the earth. Virtually all corrosion will occur at the electrode that is positive relative to the earth. A calculation of the amount of metal loss at this positive electrode, on a worst case basis, using purely electrochemical considerations, indicates that for a current density of one milliampere per square centimeter, approximately 12 millimeters will be removed from the surface of a steel plate over a period of one year. This, of course, represents a substantial erosion rate.

The impact of D.C. currents, in situations such as those under discussion, is further illustrated in Tables 1 and 2. Table 1 shows metal thickness loss by erosion, in millimeters, over a period of ten years for an electrode 0.2 meters in diameter; it assumes a one ampere D.C. current uniformly distributed over the electrode arising, for example, from electrochemical potentials developed between two widely separated electrodes in different earth media. For a D.C. current of ten amperes, the erosion rates would be ten times as great as indicated in Table 1. A naturally occurring D.C. current of one ampere is not exceptional; see FIG. 10. Currents up to about ten amperes can occur.

Table 2 shows the impact of an A.C. voltage and resulting A.C. current applied to the same electrodes as in Table 1. For the A.C. current, rather than a D.C. current, the corrosion rates are substantially smaller. At a frequency of 60 Hz, the corrosion rate is typically only about 0.1% of that for an equivalent D.C. current density. However, theoretical considerations suggest that the corrosion rate may be approximately inversely proportional to the frequency. Thus, for a 6 Hz A.C. current, as shown in Table 2, the corrosion rate could be about ten times that occurring at 60 Hz. It should be noted that the relationships indicated between corrosion rates for A.C. and D.C. signals, in Tables 1 and 2, are nominal values and may vary, in practice, by as much as an order of magnitude above and below the values set forth in the tables.

TABLE 1

| (1 Ampere Current, D.C.) | | |
|---|---|---|
| Electrode Length, Meters | Current Density, $mA/cm^2$ | Erosion, Millimeters/ 10 Years |
| 1 | 0.16 | 18.5 |
| 10 | 0.016 | 1.85 |
| 100 | 0.0016 | 0.185 |
| 1000 | 0.00016 | 0.0185 |

TABLE 2

| (100 Ampere Current, A.C.) | | | |
|---|---|---|---|
| Electrode Length, Meters | Current Density, $MA/cm^2$ | 60 Hz Erosion mm/10 Yrs. | 6 Hz Erosion mm/10 Yrs. |
| 1 | 16 | 1.85 | 18.5 |
| 10 | 1.6 | 0.185 | 1.85 |
| 100 | 0.16 | 0.0185 | 0.185 |
| 1000 | 0.016 | 0.00185 | 0.0185 |

Based on this data, it is preferred that the D.C. current density in the return electrode by less than 0.03 $mA/Cm^2$.

To improve the performance of electromagnetic downhole heating systems of the kind discussed above, utilizing D.C. cathodic protection at minimum current in accordance with the present invention, it is also desirable that certain criteria be observed with respect to the return electrodes relative to the downhole main heating electrode. Thus, in a given system the return or sacrificial electrode should have a spreading resistance (impedance to earth) of less than twenty percent of the spreading resistance of the main heating electrode. To meet this requirement, assuming cylindrical electrodes of about the same diameter, the product of the length of the sacrificial electrode and the conductivity of the formation in which it is located should be at least five times and preferably at least ten times the product of the length of the electrode in the mineral deposit and the conductivity of the formation where it is positioned.

Moreover, over a long term of operation at high A.C. heating current densities, the return electrode, due to its limited positive potential with respect to the earth, tends to drive away water by electro-osmotic effects. If high D.C. bias and A.C. heating currents are used, it is preferable that the return electrode be made hollow and perforate, so that it can be utilized to introduce replacement water into the surrounding earth; see FIG. 1. Thus, perforations 36A in return electrode 36 not only allow water to be injected into the earth formations 23 immediately surrounding that electrode, but also allow gases to enter the electrode; such gases are often developed in the area immediately surrounding the electrode.

In some localities, provision should be made to prevent accumulation of replacement water within the upper portions of the return or sacrificial electrodes 36. Such an accumulation of water could prevent the escape of gas developed around the electrode. A simple gas-lift pump activated to reduce the water head periodically, or the use of a gas permeable (but not water permeable) pipe within the return electrode, could be employed. Because the gas evolved at the anode in an electrochemical process is usually oxygen, a simple removal method is to bubble methane through the water in the return electrode for combination with the oxygen, in the presence of an appropriate catalyst.

To further minimize the maintenance of "sacrificial" return electrodes, a construction may be used with an electrode of graphite or a high silicon content iron, including a substantial chromium content, embedded in a filler matrix of coke. This kind of electrode can reduce erosion by a factor of ten or more. Standard high silicon steel (15.5%, Si, 0.7% Mn) has been used for many years in cathodic protection applications; even better performance is obtainable with the addition of about 4.25% Cr.

In all embodiments of the invention, method and apparatus, the D.C. bias current should be in a direction to preferably maintain the downhole heating electrode negative relative to the return electrode(s) but in any event at a level as close to zero as practically possible without actually going to zero. Thus, bias currents in the milliampere range are much preferred. When the A.C. heating power source is operating at 0.01 to 35 Hz, as preferred, and the output is directly connected to the electrodes, limited asymmetry in sampling of a rectifier circuit output to obtain the necessary D.C. bias voltage and current is preferred over other bias source expedients. In the following claims, any reference to an A.C. to D.C. converter for developing an intermediate D.C. output followed by a circuit which repetitively samples the intermediate D.C. output should be interpreted to include the same function in a cyclo-converter, wherein both development of the D.C. output and sampling are performed simultaneously. With an output transformer coupling the A.C. power to the heating system, a separate D.C. supply on the secondary side of that transformer is used.

I claim:

1. A method of corrosion inhibition in an electromagnetic heating system for a mineral fluid well, the heating system including a heating circuit comprising a heating electrode located downhole in the well, and an electrical power source connected to the heating circuit and operating to maintain a high amplitude A.C. heating current in the heating circuit, the method comprising the following steps:

A. applying a low D.C. bias voltage to the heating circuit, in addition to the high amplitude heating current, with a polarity to inhibit corrosion of the downhole heating electrode;

B. sensing the D.C. bias current in the heating circuit; and

C. adjusting the D.C. bias voltage to maintain the D.C. bias current sensed in step B below a given minimum level.

2. A method of corrosion protection for a mineral fluid well heating system, according to claim 1 in which, in carrying out step C, the D.C. bias current is maintained below a level of the order of one ampere.

3. A method of corrosion protection for a mineral fluid well heating system, according to claim 1, in which the A.C. heating current is supplied to the electrodes at a frequency in a frequency range of 0.01 to 35 Hz and in an amplitude range of 50 to 1000 amperes.

4. A method of corrosion protection for a mineral fluid well heating system, according to claim 3, in which, in carrying out step C, the D.C. bias current is maintained below a level of the order of one ampere.

5. A method of corrosion protection for a mineral fluid well heating system, according to claim 3, in which the electrical power source includes A.C. to D.C. converter means for developing an intermediate D.C. output and switching means for sampling that D.C. output at a heating frequency of 0.01 to 35 Hz, and in which step C is carried out by modification of the timing of the switching means to vary the durations of alternate half cycles of the power frequency.

6. A method of corrosion protection for a mineral fluid well heating system, according to claim 5 in which, in carrying out step C, the D.C. bias current is maintained below a level of the order of one ampere.

7. In an electromagnetic heating system for an oil well or other mineral fluid well, including a main heating electrode located downhole in the well at a level adjacent a mineral fluid deposit, and a return electrode at a location remote from the main electrode so that an electrical current between the electrodes passes through and heats a portion of the mineral fluid deposit, electrical energizing apparatus comprising:

a A.C. power source for generating an high amplitude A.C. heating current, of at least fifty amperes;

a D.C. bias source for generating a low amplitude D.C. bias current having a polarity such as to inhibit corrosion at the main electrode; and connection means for applying both the A.C. heating current and the D.C. bias current to the electrodes of the well heating system.

8. Electrical energizing apparatus for A.C. heating and D.C. corrosion inhibition in a mineral fluid well, according to claim 7, and further comprising:

D.C. sensor means for sensing the D.C. bias current; and amplitude adjusting means in the D.C. bias source, connected to the D.C. sensor means, for maintaining the D.C. bias current below a given amplitude.

9. Electrical energizing apparatus for A.C. heating and D.C. corrosion inhibition in a mineral fluid well, according to claim 8, in which the given amplitude for the D.C. bias current is one ampere.

10. Electrical energizing apparatus for A.C. heating and D.C. corrosion inhibition in a mineral fluid well, according to claim 9, in which the frequency of the A.C. heating current is in the range of 0.01 to 35 Hz.

11. Electrical energizing apparatus for A.C. heating and D.C. corrosion inhibition in a mineral fluid well, according to claim 7, in which the A.C. power source comprises A.C. to D.C. conversion means for developing an intermediate D.C. output, and switching means for sampling that D.C. output at a heating current frequency of 0.01 to 35 Hz, and in which the D.C. bias source is an integral part of the A.C. power source, comprising means for asymmetrically actuating the switching means to vary the durations of alternate half cycles of the heating current frequency.

12. Electrical energizing apparatus for A.C. heating and D.C. corrosion inhibition in a mineral fluid well, according to claim 11, and further comprising:

D.C. sensor means for sensing the D.C. bias current; and amplitude adjusting means in the D.C. bias source, connected to the D.C. sensor means, for maintaining the D.C. bias current below a given amplitude.

13. Electrical energizing apparatus for A.C. heating and D.C. corrosion inhibition in a mineral fluid well, according to claim 12, in which the given amplitude for the D.C. bias current is one ampere.

14. Electrical energizing apparatus for A.C. heating and D.C. corrosion inhibition in a mineral fluid well, according to claim 7, in which the return electrode is a hollow, multi-perforate metal cylinder buried in the earth at a location remote from the main electrode.

15. Electrical energizing apparatus for A.C. heating and D.C. corrosion inhibition in a mineral fluid well according to claim 14, in which the product of the length of the return electrode and the conductivity of the formation in which it is located is at least five times the product of the length of the main electrode and the conductivity of the reservoir where it is positioned.

16. Electrical energizing apparatus for A.C. heating and D.C. corrosion inhibition in a mineral fluid well, according to claim 15, and further comprising:

D.C. sensor means for sensing the D.C. bias current; and amplitude adjusting means in the D.C. bias source, connected to the D C. sensor means, for maintaining the D.C. bias current below a given amplitude.

17. Electrical energizing apparatus for A.C. heating and D.C. corrosion inhibition in a mineral fluid well, according to claim 15, in which the A.C. power source comprises A C. to D.C. conversion means for developing an intermediate D.C. output and switching means for sampling that D.C. output at a heating current frequency of 0.01 to 35 Hz, and in which the D.C. bias source is an integral part of the A.C. power source, comprising means for asymmetrically actuating the switching means to vary the durations of alternate half cycles of the heating current frequency.

18. Electrical energizing apparatus for A.C. heating and D.C. corrosion inhibition in a mineral fluid well, according to claim 17, and further comprising:

D.C. sensor means for sensing the D.C. bias current; and amplitude adjusting means in the D.C. bias source, connected to the D.C. sensor means, for maintaining the D.C. bias current below a given amplitude.

19. Electrical energizing apparatus for A.C. heating and D.C. corrosion inhibition in a mineral fluid well, according to claim 18, in which the given amplitude for the D.C. bias current is one ampere.

20. Electrical energizing apparatus for A.C. heating and D.C. corrosion inhibition in a mineral fluid well, according to claim 7, in which the connection means comprises an output transformer, and the D.C. bias source is connected to the secondary of the output transformer.

21. Electrical energizing apparatus for A.C. heating and D.C. corrosion inhibition in a mineral fluid well, according to claim 20, and further comprising:

D.C. sensor means for sensing the D.C. bias current; and amplitude adjusting means in the D.C. bias source, connected to the D.C. sensor means, for maintaining the D.C. bias current below a given amplitude.

22. Electrical energizing apparatus for A.C. heating and D.C. corrosion inhibition in a mineral fluid well, according to claim 21, in which the given amplitude for the D C. bias current is one ampere.

23. Electrical energizing apparatus for A.C. heating and D.C. corrosion inhibition in a mineral fluid well, according to claim 22, in which the frequency of the A.C. heating current is in the range of 0.01 to 35 Hz.

24. Electrical energizing apparatus for A.C. heating and D.C. corrosion inhibition, according to claim 8 in which the main electrode is a perforated section of a conductive casing for the well, the connection means includes production tubing extending coaxially of the well in spaced relation to the casing and an electrical connector between the tubing and the main electrode, and the return electrode is a section of conductive casing for the well positioned above and electrically isolated from the main electrode.

25. Electrical energizing apparatus for A.C. heating and D.C. corrosion inhibition in a mineral fluid well, according to claim 24, in which the given amplitude for the D.C. bias current is one ampere.

26. Electrical energizing apparatus for A.C. heating and D.C. corrosion inhibition in a mineral fluid well, according to claim 7, in which the spreading resistance of the main electrode is at least five times that of the return electrode and the D.C. current density in the return electrode is less than 0.03 $mA/cm^2$.

27. Electrical energizing apparatus for A.C. heating and D.C. corrosion inhibition in a mineral fluid well according to claim 26, in which the product of the length of the return electrode and the conductivity of the formation in which it is located is at least five times the product of the length of the main electrode and the conductivity of the reservoir where it is positioned.

28. Electrical energizing apparatus for A.C. heating and D.C. corrosion inhibition in a mineral fluid well, according to claim 26, and further comprising:

D.C. sensor means for sensing the D.C. bias current; and amplitude adjusting means in the D.C. bias source, connected to the D.C. sensor means, for maintaining the D.C. bias current below a given amplitude.

29. Electrical energizing apparatus for A.C. heating and D.C. corrosion inhibition in a mineral fluid well, according to claim 26 in which the A.C. power source comprises A.C. to D.C. conversion means for developing an intermediate D.C. output and switching means for sampling that D.C. output at a heating current frequency of 0.01 to 35 Hz, and in which the D.C. bias source is an integral part of the A.C. power source, comprising means for asymmetrically actuating the switching means to vary the duration of in alternate half cycles of the heating current frequency.

30. Electrical energizing apparatus for A.C. heating and D.C. corrosion inhibition in a mineral fluid well, according to claim 29, and further comprising:

D.C. sensor means for sensing the D.C. bias current; and amplitude adjusting means in the D.C. bias source, connected to the D.C. sensor means, for maintaining the D.C. bias current below a given amplitude.

31. Electrical energizing apparatus for A.C. heating and D.C. corrosion inhibition in a mineral fluid well, according to claim 30, in which the given amplitude for the D.C. bias current is on ampere.

* * * * *